US005990880A

United States Patent [19]

Huffman et al.

[11] Patent Number: 5,990,880

[45] Date of Patent: Nov. 23, 1999

[54] BEHAVIORALLY BASED ENVIRONMENTAL SYSTEM AND METHOD FOR AN INTERACTIVE PLAYGROUND

[75] Inventors: Bradley L. Huffman, Chandler, Ariz.; Victor H. Lang, Ft. Collins, Colo.

[73] Assignee: CEC Entertaiment, Inc., Irving, Tex.

[21] Appl. No.: 08/791,873

[22] Filed: Jan. 31, 1997

Related U.S. Application Data

[62] Division of application No. 08/348,363, Nov. 30, 1994, Pat. No. 5,740,321.

[51] Int. Cl.[6] ..... B65D 35/00

[52] U.S. Cl. ..... 345/302; 706/45

[58] Field of Search ..... 345/302; 706/45, 706/48, 50, 52, 57, 59, 60; 707/501; 463/9, 23

[56] References Cited

U.S. PATENT DOCUMENTS

| | | | |
|---|---|---|---|
| 4,176,395 | 11/1979 | Evelyn-Veere | 361/528.19 |
| 4,434,460 | 2/1984 | Drakenborn | 395/885 |
| 4,754,410 | 6/1988 | Leech | 706/45 |
| 4,959,799 | 9/1990 | Yoshiura | 706/48 |
| 5,027,305 | 6/1991 | Tanaka | 706/48 |
| 5,081,707 | 1/1992 | Schorman | 455/186.1 |
| 5,111,409 | 5/1992 | Gasper et al. | 345/302 |
| 5,165,011 | 11/1992 | Hisano | 706/50 |
| 5,167,012 | 11/1992 | Hayes | 706/60 |
| 5,179,634 | 1/1993 | Matsunaga | 706/59 |
| 5,329,612 | 7/1994 | Kakazu | 706/59 |
| 5,390,287 | 2/1995 | Obata | 706/57 |
| 5,400,246 | 3/1995 | Wilson | 364/146 |
| 5,459,816 | 10/1995 | Baseshore | 364/148.05 |
| 5,485,550 | 1/1996 | Dalton | 706/52 |
| 5,510,975 | 4/1996 | Ziegler | 364/148.04 |
| 5,513,129 | 4/1996 | Bolas | 364/578 |
| 5,515,476 | 5/1996 | Nishidai | 706/3 |
| 5,517,613 | 5/1996 | Brant | 395/180 |
| 5,546,506 | 8/1996 | Araki | 706/61 |
| 5,604,855 | 2/1997 | Crawford | 345/473 |
| 5,619,709 | 4/1997 | Caid et al. | 707/532 |
| 5,740,321 | 4/1998 | Huffmann et al. | 395/10 |
| 5,782,692 | 7/1998 | Stelovsky | 463/1 |

OTHER PUBLICATIONS

Rodney A. Brooks, "A Robust Layered Control System for A Mobile Robot," IEEE Journal of Robotics and Automation, vol. RA–2, No. 1,3/86, pp. 14–23.

Muhammad Muazzam Ali, "Exploration–Based Design Synthesis of Behavior–Based Autonomous Robots," PhD. disseratation, Colorado State University (Fort Collins), Summer, 1994, pp. 1–130.

*Primary Examiner*—Stephen S. Hong
*Attorney, Agent, or Firm*—Baker & McKenzie

[57] ABSTRACT

A system and method for controlling an interactive playground in which aspects of the playground are dynamically varied based on input signals from sensors in the playground. The system includes a system supervisor unit that utilizes a rule file, a scene file and a MIDI file in conjunction with a variety of sensor input to create an appropriate system response. Output control signals generated by the system supervisor unit are transmitted to other coupled computers to effectuate audio, visual and other effects in an interactive playground environment. The system supervisor has the desirable ability to load different scene, rule and MIDI files to create different system behavior in response to sensor stimuli, thereby creating a more adaptive behavioral based environment.

10 Claims, 4 Drawing Sheets

Microfiche Appendix Included
(3 Microfiche, 112 Pages)

BEHAVIORALLY BASED ENVIRONMENTAL SYSTEM AND METHOD FOR AN INTERACTIVE PLAYGROUND

This is a division of application Ser. No. 08/348,363, filed on Nov. 30, 1994 U.S. Pat. No. 5,740,321. A microfiche appendix is included, containing 3 microfiches and a total of 112 frames.

FIELD OF THE INVENTION

The present invention generally relates to an apparatus and method for sensing physical and temporal changes in an environment and providing a response that varies with a plurality of those changes. More particularly, the present invention relates to a behavioral based environment system for controlling an interactive playground that changes the rules determining its output in response to multiple stimuli associated with the playground and people within it.

BACKGROUND OF THE INVENTION

Environments whose purpose is to entertain, educate or otherwise hold the attention of its participants risk becoming boring when each response is tied to a single input stimulus and the result is invariably the same. In such a system the amount of interaction is low and the result highly predictable. Presently, this is the condition of so-called interactive playgrounds. Present interactive playgrounds respond in the same way to a stimulus without significant variation over time. As these environments become predictable to the participants they correspondingly run the risk of becoming boring to those participants. Eventually, bored participants will choose to avoid such an environment. Thus, whether or not a particular environment becomes boring will often have economic and other consequences for the owners of such an environment. The degree of interaction and the predictability of the environment's response are two important factors in determining whether an environment becomes boring or not.

Presently, interactive playground environments utilize strict rule based systems to control their response. A strict rule based system always responds to stimuli according to one rule. The control is of a top-down type variety in the sense that there is a static set of rules that mediates the output response in a deterministic way.

FIG. 1 illustrates such a rule based system. In FIG. 1, outputs from sensors 10 are transmitted to a computer executing a set of rules 12. The set of rules 12 determine what response 14 is appropriate based on the sensor output 10. The set of rules 12 does not change.

In FIG. 2 the set of rules block 12 in FIG. 1 is expanded to show typical functional sub-systems within the rules block 12 to better illustrate the strict rule based system. The sequential nature of a strictly rule based system requires a perception unit 16 to process information from the sensors 10. The system 12 then updates its current information from the environment in the mapping unit 18. A planning unit 20 and an execution unit 22 then derive and transmit the response 14. These units individually do not have the ability to respond as a system, nor is every unit capable of creating any type of observable behavior in the output. Thus, the strictly rule based system takes an input and operates on that input to produce a result. For the same input, the same result is produced every time. This is often referred to in the art as "hit and run" animation. The designer of this type of system assumes a static problem domain, i.e. the response is static. Ultimately, participants in the strict rule based interactive playground discover the playground is too predictable, then those participants lose interest and avoid it.

In order to keep the participants' attention and reduce the risk of boredom, it would be desirable to have an interactive playground that is less predictable. Furthermore, it would be desirable for an interactive playground to promote higher levels of interaction with its participants.

SUMMARY OF THE INVENTION

The present invention improves an interactive playground by flexibly changing a set of rules that convert sensor output into system responses. Furthermore, the present invention is responsive to multiple input signals for each rule determination.

More specifically, the present invention provides a method and apparatus for responding to multiple input signals both to change playground response and to change the set of rules determining that response. The input signals include signals from different types of sensors, a time signal, a date signal and a gaming status signal which are indicative of the level of performance of participants in the interactive playground. The response can be displayed in output devices such as lights and speakers.

A preferred embodiment of present invention employs a system supervisor unit to effectuate a behavioral based environmental system for controlling an interactive playground. The system supervisor unit is a programmed computer that receives input signals from a variety of sensors coupled to it, as well as a time signal, a date signal and a gaming status signal. The system supervisor unit indirectly controls output devices such as lights and speakers by applying received input signals to a current set of rules in a rule file to determine which scenes in a scene file are to be performed. Selected scenes manifest themselves through control of the output devices. Furthermore, scenes can cause the system supervisor unit to replace the current rule file with another rule file stored in memory.

BRIEF DESCRIPTION OF THE DRAWINGS

Other aspects and advantages of the invention will become apparent upon reading the following detailed description and upon reference to the accompanying drawings, in which.

DETAILED DESCRIPTION OF THE PREFERRED EMBODIMENTS

Figure 1:
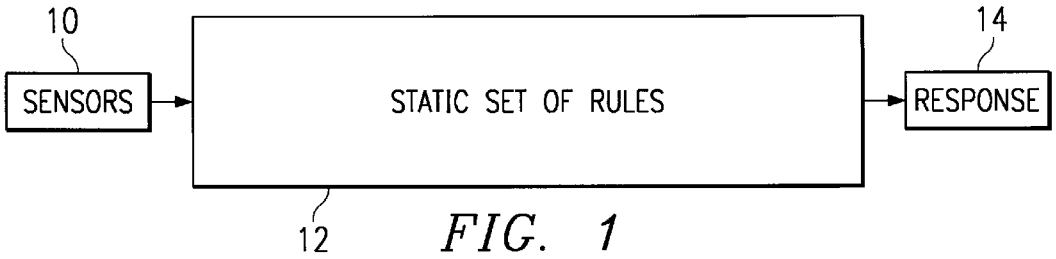
FIG. 1 (PRIOR ART)
FIG. 1 is a flow chart of a prior art rule based system at a high level.
Figure 2:
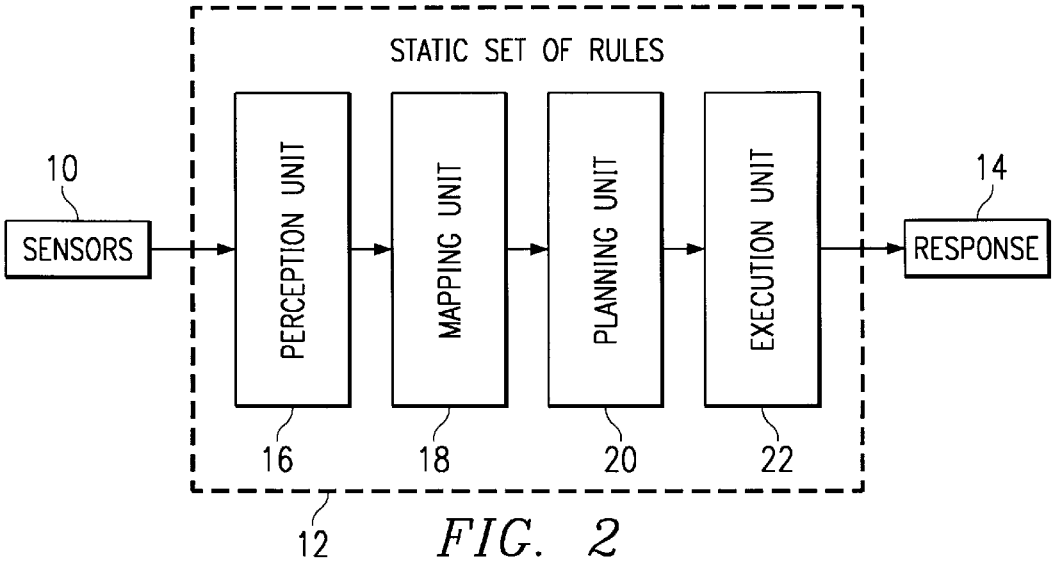
FIG. 2 (PRIOR ART)
FIG. 2 is a flow chart of a prior art rule based system at a more detailed level than FIG. 1.

While the invention is susceptible to various modifications and alternative forms, a number of specific embodiments thereof have been shown by way of example in the drawings and will be described in detail herein. It should be understood, however, that this is not intended to limit the invention to the particular forms disclosed. On the contrary, the intention is to cover all modifications, equivalents and alternatives falling within the spirit and scope of the invention as defined by the appended claims.

The Behavioral Based Environment System (BBES) is an entertainment environment that provides a less predictable and more interactive solution to the field of "interactive entertainment", specifically, interactive playgrounds. The BBES provides a degree of surprise and uncertainty to the overall output of the system to make interaction with it more enjoyable. Participants interacting with the BBES influence and are influenced by the BBES to keep the participants' interest and encourage all participants to influence the response of the BBES. It should be noted that the BBES contains a current set of rules as part of its operation. However, unlike a strict rule based system, the BBES adapts itself to the changing environment by changing the rule file. The BBES changes the rule file based in part on what sensors indicate participants are doing and when. The ability to flexibly change the rule file in response to the environment is a desirable feature not found in other interactive playgrounds.

The BBES can be characterized as a decentralized method of control in which each set comprised of a scene file, rule file and musical instrument digital interface file is competent to perform a certain task. The combined efforts of each set of files serve to realize the desired response of the system. The BBES is therefore considered to be an incremental "bottom-up" approach to the building of automated systems. In comparison to a strictly rule based system, the BBES operates more independently and influences the nature of the system output. Stated another way, each set of files allows the system to provide a distinct and observable behavior to the system output. The BBES approach views the overall system response as a collection of behaviors exhibited by each set of scene, rule and Musical Instrument Digital Interface (MIDI) files. In contrast to enhancing a module in a strictly rule based system, BBES systems are improved by adding additional files that act as experts at particular tasks to improve overall system competency.

In accordance with the present invention, each set of scene, rule and Musical Instrument Digital Interface (MIDI) files is a separate complete entity that controls a system response in accordance with a participant's observable behavior or activity level in the environment. Depending on input from the environment, e.g. time of day, date, sensor output and gaming status, a system supervisor unit described fully below uses a current rule file to select one scene file and one MIDI file to control BBES response while other files are inhibited. When the environment changes, the current rule file may select a different scene file and MIDI file to be current, i.e. assume control. Furthermore, a current scene file can select a new rule file to become current. There is no "master" rule-base for this system. Each scene file, MIDI file and rule file are individually their "own" masters.

Figure 3:
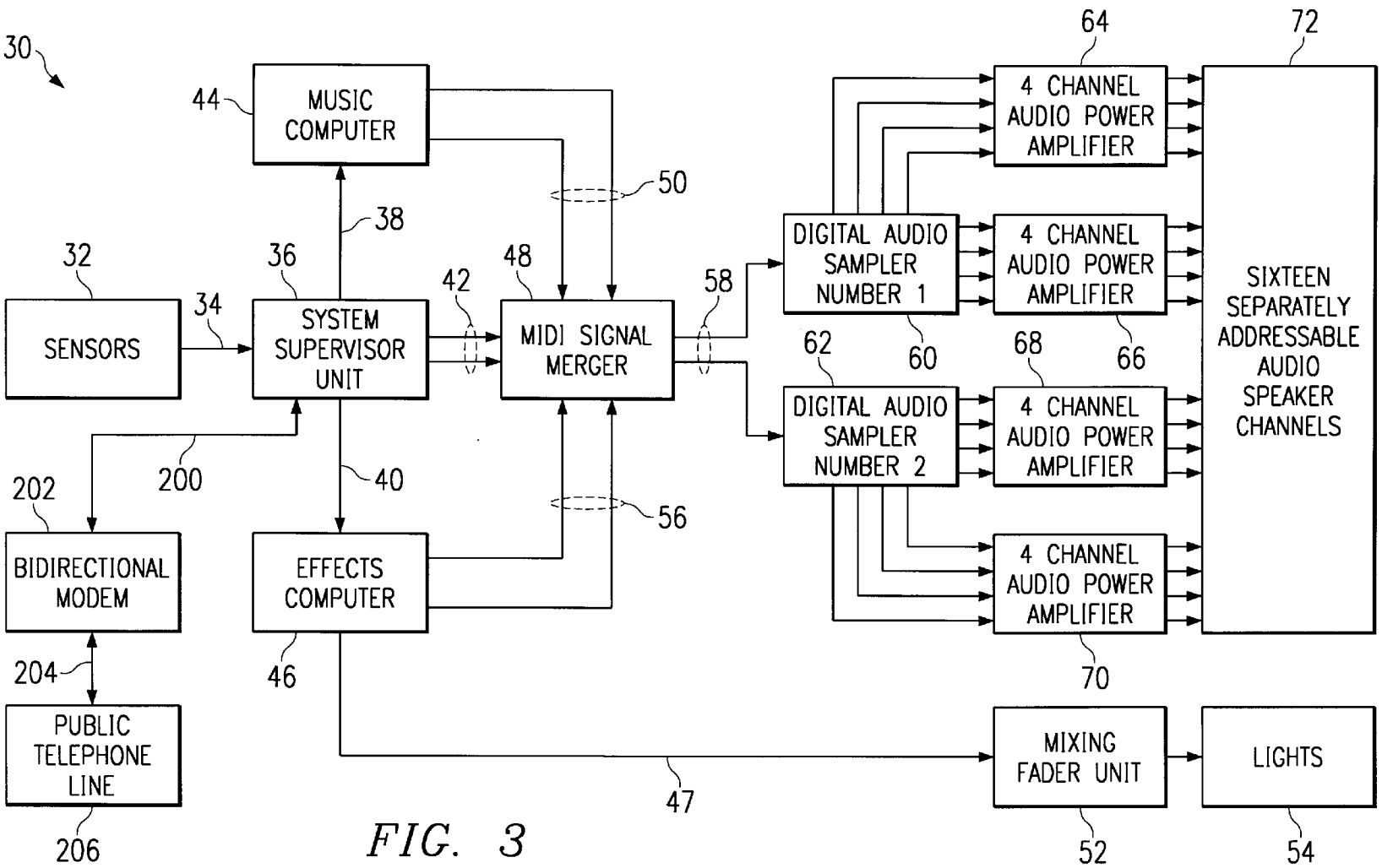
FIG. 3 is a block diagram overview of a hardware configuration of a behavioral based environmental system (BBES) according to one embodiment of the present invention.

A block diagram overview of the BBES hardware is illustrated in FIG. 3 with a full explanation on the detail provided below. FIG. 3 shows one embodiment of a behavioral based environment system 30 (BBES) according to the present invention. Sensors 32 are placed throughout an interactive playground (not shown) to monitor physical changes that occur such as the presence or absence of a child (not shown). Sensor output 34 typically from many sensors 32 is driven to a system supervisor unit 36, which is a key component of the BBES 30. The system supervisor unit 36 is a computer programmed with a software utility known as an ACME system supervisor utility (refer to FIG. 4). The system supervisor unit 36 is responsible for maintaining a rule file, a scene file and a musical instrument digital interface (MIDI) file. only one rule file, scene file and MIDI file is active at any one time. Through application of these files the system supervisor unit 36 creates a music control signal 38, an effects control signal 40 and a pair of MIDI control signals 42 as prompted by the sensor output 34.

The sensors 32 include both passive and active devices. In one embodiment of the present invention, all sensors 32 that are active are powered by a 12 volt supply. All sensors 32 send "change of state" information to the system supervisor unit 36. For example, a ±5 volt pulse from each active sensor 32 will indicate to the system supervisor unit 36 that a sensor 32 was tripped. Zero volts from a sensor 32 indicates a non-tripped condition. In one embodiment four different kinds of sensors 32 are utilized.

A first kind of sensor 32 employed in one embodiment of the present invention is a microwave proximity sensor such as that manufactured by Micro Alarm Systems, Inc., 4809 East Firestone Blvd, Southgate, Calif. 90280. The microwave proximity sensor emits a ultra-high frequency radio signal that detects movement within an adjustable range of the sensor. The microwave proximity sensor is insensitive to wind or air movement, temperature, sunlight or noise. The radio signal can pass through plastic, glass, and upholstery materials and can be shielded somewhat with metallic materials. It is an active type sensor utilizing a 12 volt supply.

A second kind of sensor 32 employed in one embodiment of the present invention is a programmable optical sensor such as that manufactured by Pepperl+Fuchs, Inc., 1600 Enterprise Parkway, Twinsburg, Ohio 44087-2202. The optical sensor can be configured for sensing variable light/dark conditions. An adjustable timer allows the output pulse width to be modulated. The optical sensor can be used in conjunction with a polarized reflector to increase its sensing distance. The wavelength of the emitted light is in the visible or infrared range using an LED as the source. Sensors used with a reflector typically use light sources in the visible range and those without reflectors use an infrared source. The sensor is an active device requiring a 12 volt DC power supply.

A third kind of sensor 32 employed in one embodiment of the present invention is an impact sensor such as that manufactured by Select Controls Inc., 350 I Central Avenue, Bohemia, N.Y. 11716. This impact sensor is a passive devices requiring no power source. The device is essentially a switch in a normally open configuration. When an impact of 5 Gs or more are applied to the impact switch it forces electrical contact within the impact switch, thereby closing it. Since an impact is typically of short time duration, the amount of time the switch remains closed is not long enough for the system supervisor unit to be able to register the event. Signal conditioning is therefore required to lengthen the pulse generated by the impact switch to a value that the system supervisor unit can read.

A fourth kind of sensor 32 employed in one embodiment of the present invention is a pressure sensor such as that sold by Allied Electronics Inc., 7410 Pebble Drive, Fort Worth, Tex. 76118. Similar to the impact sensors, the pressure sensor is also a passive switch device in a normally open configuration. When pressure is applied to the device, electrical contact is made, thereby closing the switch. Eight ounces of "normal finger pressure" are required to close the switch contact.

The system supervisor unit 36 is a computer programmed with the software utility named the ACME system supervisor utility. The system supervisor unit 36 receives sensor output 34 from the sensors 32 described above. The ACME System Supervisor Utility is a software utility running in the system supervisor unit 36 computer that can send information to a music computer 44, an effects computer 46 and, via the pair of MIDI control signals 42, directly to a MIDI signal merger 48. Note that up to eight effects computers, eight music computers and eight MIDI lines can be accommodated in one embodiment of the present invention. The system supervisor unit 36 reads the scene file, rule file and, if directed to, the MIDI file to determine the appropriate output for the given state of the BBES. The system supervisor unit 36 can be configured via a scene and rule file to run games or other scenarios. While the system supervisor unit software is running, each frame (one frame equals 1/30th of a second), it does the following:

Read external events

Decrement timers

Read the keyboard, process an entry when ENTER is pressed

Test all rules in the rule file

Run any scenes that need to be run

Update the screen

The scene, rule, and MIDI files all work in conjunction with each other and are fully described below.

The scene file includes the following information:

Description: 1 to 30 character text description of the scene.

Priority: 1–100, 1 is lowest priority of a scene.

Duration: 0–1000000, length of a scene in frames (30 frames/sec).

Non-repeat: 0–1000000, number of frames a scene is prevented from repeating.

Spool: 0–1000000, number of frames a scene will spool is blocked by a priority.

Mix1–Mix8: 0–999, cue point for computer running the MIX program, 0 means do not cue. Each of the eight mix fields specifies a target device, while a number placed in that field selects a particular numbered effect to be run.

MIDI1–MIDI8: 0–999, number of MIDI command to send out serial port 1–8. MIDI commands are stored in the MIDI file. Each of the eight MIDI fields specifies a MIDI target device, while a number placed in that field selects a particular numbered effect to be run.

Each individual scene in the scene file contains information as to the nature of the system output. The output can be in the form of lighting, sound, or other special effects. The description is a text string that describes the form of the output. For example, a sound effect description might be entitled "Crowd_Cheer" to describe a crowd cheer type sound effect. "Flicker_Lights" might be the description of a lighting effect scene. Another important function of the description is to serve as a file name to load an entirely new scene, MIDI, and rule file. Each line of the scene file is assigned a priority that dictates the order in which all of the scenes will run. The scenes which have a higher priority will naturally run first and block all lower priority scenes from running. When a scene runs, a timer starts counting down from the number in the duration filed to zero. (Refer to illustrative example below.) While duration is non-zero, priority for that scene is assigned to all machines that have a non-zero value in the mix field. While the duration is non-zero, no other lower priority scenes may run. When the duration becomes zero, the next highest priority scene commences to run. If a scene attempts to run and is blocked by a higher priority scene, the system supervisor unit 36 will continue to attempt to run the lower priority until the spool field counts down from the value stored there to zero. If the spool time expires before the higher priority scenes have finished running, the lower priority scene will never run until it is called again by the rule file. The non-repeat field is the amount of time in frames that a scene is prevented from running after it is run the first time. The mix1–mix8 and MIDI1–MIDI8 fields specify the devices that the system supervisor unit will send output. Mix1–mix8 refers to the computers that control certain effects, as described fully below. The effects computer 46 is an example of a device that can accept this type of information. MIDI1–MIDI8 refers to computers or other devices that are capable of receiving information in the MIDI format, as described fully below.

The MIDI file is a file referenced by the scene file in the MIDI1–MIDI8 fields. This file sends information to MIDI devices only, e.g. the music computer 44, the effects computer 46, and the MIDI signal merger 48. MIDI protocol requires a certain information format that this MIDI file provides. Specifically, the MIDI file includes the following information:

Number: 1–100, reference number of the MIDI command

Type: ON (note on), OFF (note off), PC (program change)

Channel: 1–16, MIDI channel number

Value: Note number of program change number, 0–127

Velocity: 0–127, Influences the sound quality

The rule file provides the control logic for a given scene file and MIDI file. It is a series of conditional statements that resembles that of traditional programming languages. The rule file consists of variables, timers, and logical operators. Dependent on the logic of a given rule file, two courses of action can occur: (1) individual scenes within a scene file are run to create a response observable by participants in the interactive playground or (2) a completely new scene, rule, and MIDI file are loaded to compensate for a change in the interactive playground.

The following lines give an example of some of the typical rules used in a rule file:

V1+1E3^1 ;increment V1 When sensor E3 is pressed (changes from 0 to 1)

V1−1E6^1 ;decrement V1 when sensor E6 is pressed

V1*0E7^1 ;set variable V1 to 0 when E7 is pressed

V0*V3E4^1 ;set V0 to value of V3 when E4 is pressed

V2*1V4&V5 ;set V2 to 1 if both V4 and V5 are non zero

T1*90E5^1 ;set time T1 to 90 frames when E5 is pressed

S3*1E3^1 ;run scene S3 when switch E3 is pressed

S4*1V1=6 ;run scene S4 when V1==6

Through application of the rule, scene and MIDI files, the sensor output 34 prompts the system supervisor unit 36 to determine an appropriate system response. One such response begins in the form of the music control signal 38. The music control signal 38 is transmitted from the system supervisor unit 36 to the music computer 44.

The music computer 44 receives the music control signal 38 which directs the music computer 44 to play a pre-sequenced "song" that has been recorded using sequencing software. The music computer 44 is responsible for providing and controlling the playing musical sequences longer than a few seconds. In one embodiment the sequencing software is Cakewalk Professional 3.0 from Twelve Tone Systems, Inc., P.O. Box 760, Watertown, Mass. 02272-0760. There is a general difference in length between a "song" and a "sample". A "song" is a musical piece that can last between about 30 seconds and ten minutes in length. A "sample" is usually a quick audio response of not more than a thirty seconds. Providing a cue to MIDI devices are the MIDI1–MIDI8 fields located in the scene file of the system supervisor unit, as described above. The cue specifies a device and song that device should play. Once the music computer 44 has received the cue from the system supervisor unit 36, and no other machines with a higher priority are blocking it, the music computer 44 transmits MIDI information such as Program change, Note On/Off, Note Number, Velocity, etc. The MIDI information is transmitted over at least one line of a pair of MIDI lines 50, both of which are received by the MIDI signal merger 48. The song that is played depends on what program change number is used within the MIDI file of the system supervisor unit 36.

The music computer 44 is generally responsible for storage and retrieval of longer duration songs, while the system supervisor unit 36 is generally responsible for short duration musical samples. This dichotomy solves the problem of managing the large amounts of memory it takes to store songs. Note that a sample of only a few seconds can take up nearly one megabyte of space. Thus, songs take up even more significant amounts of memory because of their greater duration. Sequencing software is used in the music computer 44 to store the songs information. After the song information is retrieved from the music computer 44, it is transmitted over one line of the pair of MIDI lines 50 to the MIDI signal merger 48.

Like the music computer 44, the effects computer 46 receives its instructions from the system supervisor unit 36. The system supervisor unit 36 drives the effects control signal 40 to the effects computer 46, for example, to prompt lighting effects. Other effects controlled by the effects computer such as those produced by fog, smoke and wind machines are envisioned as well. The effects control signal 40 includes cues in the MIDI1–MIDI8 fields and the mix1–mix8 fields of the scene file in the system supervisor unit 36 directing a particular effects computer 46 to respond with a particular effects sequence. Note that up to eight effects computers 46 can be attached to the system supervisor unit 36 in one embodiment of the present invention. But like the music computer 44, the effects computer 46 can only send output if there are no other higher priority machines blocking it from running. One difference between the effects computer 46 and the music computer 44 is that the music computer 44 is considered a MIDI device, while the effects computer 46 is considered a Mix device. A Mix device is accessed by the appropriate mix1–mix8 field in the scene file. A MIDI device is controlled by the appropriate MIDI1–MIDI8 field in the scene file. The information in the mix1–mix8 fields of the scene file tells the effects computer 46 to play a pre-programmed lighting sequence. The information in the MIDI1–MIDI8 fields allows the effects computer 46 to synchronize its lighting effects to an audio response generated by the music computer 44 or the system supervisor unit 36. Note that in one embodiment the effects computer 46 drives a fader control line 47 to a mixing fader unit 52 which in turn controls lights 54. The fader control line 47 carries the control signals instructing the mixing fader unit 52. The mixing fader unit 52 is adapted to control the voltages required by the lights 54. The effects computer 46 also drives a pair of MIDI lines 56, both of which are received by the MIDI signal merger 48.

MIDI (Musical Instrument Digital Interface) is an information protocol that is commonly used by electronic instrument manufacturers to communicate information between musical devices. Computers "speak" MIDI to the various MIDI devices used in the system through the use of expansion boards. The MIDI signal includes a Note On/Note Off, Program Change, Velocity, MIDI Channel, and Note Number. Note On/Note Off merely means to play or stop playing a given musical note specified on the Note Number. The Note Number is a number that refers to the notes as seen on a typical piano keyboard. Each MIDI program can contain a set of notes (1–127). When a Program Change is specified via MIDI a new set of notes with different sounds can be accessed. From the musicians perspective, this allows many different instruments to be played on the same physical instrument. When using multiple MIDI devices, it is possible to select a single MIDI device by assigning it a MIDI Channel. In this way only that particular device will receive the information if the other devices are operating on different channels. Finally, the Velocity of a note refers to the speed at which a key is pressed on a typical piano keyboard. Different velocities correspond to different sounds on the keyboard.

In one embodiment of the present invention, the MIDI signal merger 48 is implemented in a MIDI Time Piece II by Mark of the Unicorn, Inc., 1280 Massachusetts Ave., Cambridge, Mass. 02138. The MIDI Time Piece II is a MIDI signal multiplexing device that allows up to 8 input devices to be assigned in any combination to up to 8 output devices. For the BBES 30, the MIDI signal merger 48 is configured to merge the two MIDI signals from the system supervisor unit 36, the two MIDI signals from the music computer 44, and the two MIDI signals from the effects computer 46 (total of 6 MIDI lines) into two MIDI Lines (refer to FIG. 3). The MIDI signal merger 48 makes sure that the proper information is routed to the appropriate MIDI output device. In this case the output devices are a digital audio sampler #1 60 and a digital audio sampler #2 62. The MIDI signal merger 48 is desirable because each of the digital audio samplers 60, 62 have only one MIDI line input and there are three MIDI lines that need to be routed to each digital audio sampler.

In one embodiment of the preferred invention, digital audio sampler #1 60 and digital audio sampler #2 62 are implemented in a CD3000 Akai Digital Audio Sampler by Akai Electric Co. Ltd, of Tokyo Japan. The Akai digital audio sampler allows the playback of a pre-recorded audio sample on up to eight user specifiable outputs. The Akai unit can store up to 32 megabytes of digitally recorded sounds. These sounds can be edited within the digital audio sampler to the desired length, pitch, and volume, etc. Once the sample has been edited it is placed in a program for playback. In the BBES 30 each sample is assigned to a keygroup. A keygroup may consist of one keygroup for the entire keyboard or one keygroup for each note on the keyboard. Within the Akai sampler, this keygroup can be represented as an actual musical note (like C# or F) or as a number (1–127). The following figure depicts how the Akai sampler receives information and sends output. The digital audio samplers use memory to store the individual instrument's sound. These sounds are only a few seconds at most in length and can be used for more than one song.

As illustrated in FIG. 3, both digital audio samplers 60, 62 transmit eight signals. The eight signals are organized into two groups of four signals. Because two digital audio samplers 60, 62 are used, four groups of four signals each are received by four four-channel audio power amplifiers 64, 66, 68, and 70. Thus, in one embodiment of the present invention there are four amplifiers 64, 66, 68, and 70 driving sixteen separately addressable audio speaker channels 72. Each audio channel can drive at least one speaker associated with it to produce an audio output.

The output transmitted by the system supervisor unit 36 can take on a variety of forms. Audio responses can be provided in the form of short sound bites or longer songs. The system supervisor unit 36 and the music computer 44 are responsible for the sound bytes and songs respectively. Lighting and other special effects such as fog, smoke and wind, as well as some sound effects are mediated by the effects computer 46. All audio information sent from the system supervisor unit 36, music computer 44, or effects computer 46 is merged into two signals by the MIDI signal merger 48. Of the two resulting signals, one is sent to Digital Audio Sampler #1 60 and the other is sent to Digital Audio Sampler #2 62. The digital audio samplers 60, 62 contain the basic sounds that are referenced by the three computers. Depending on the MIDI signals received by the digital audio samplers 60, 62, each of the digital audio samplers can send the audio response to any of eight separately addressable speaker channels. Thus for two digital audio samplers, up to sixteen separately addressable speaker channels 72 are available. The audio is then amplified to a suitable volume level and played out the appropriate speaker.

Figure 4:
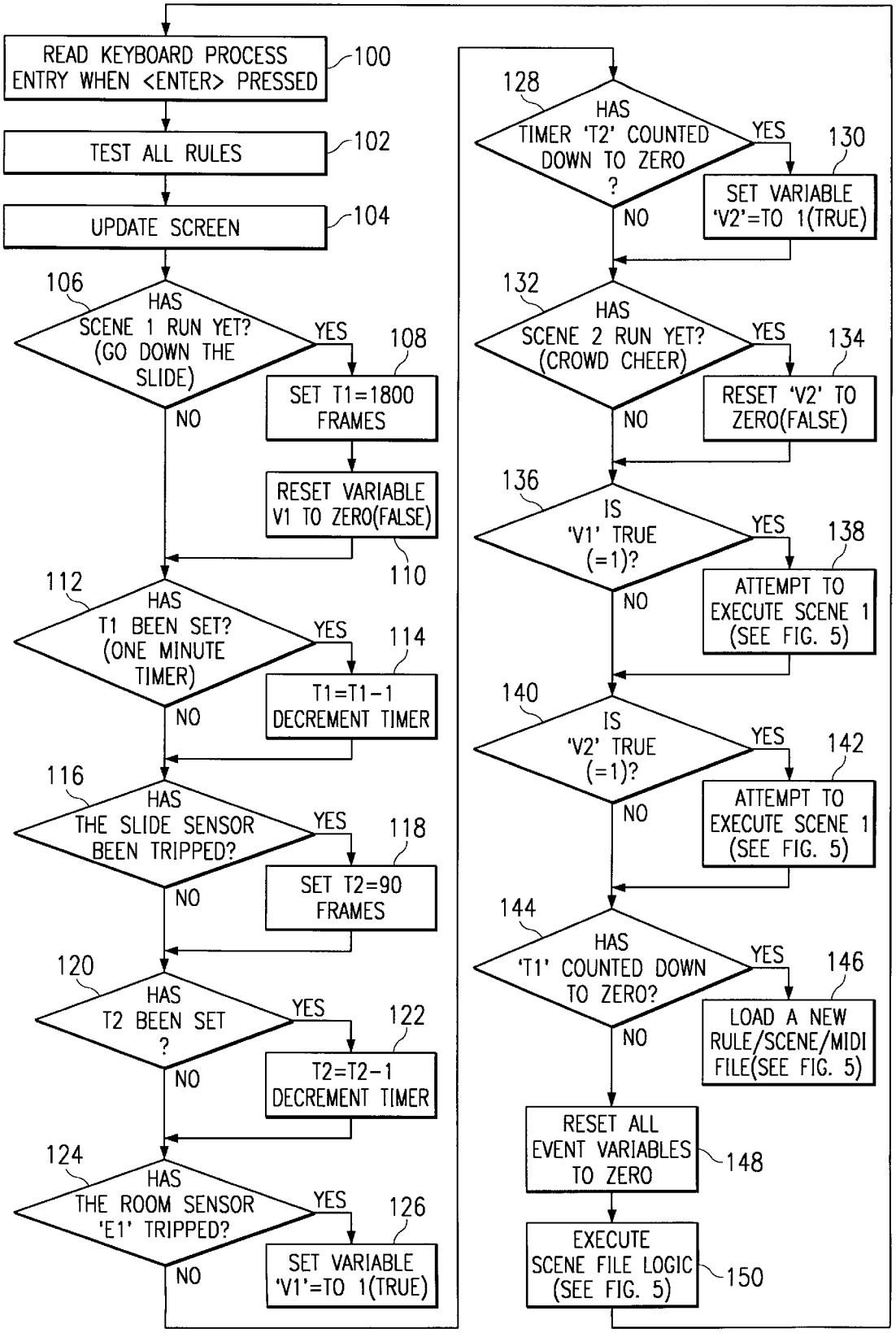
FIG. 4 is a flow chart of an illustrative example of a behavioral based environmental system (BBES) according to one embodiment of the present invention.

FIG. 4 shows an illustrative example of how the system supervisor unit utilizes the scene, rule and MIDI files to achieve a response for the BBES in an interactive environment. The interactive environment includes a small room situated at the top of a slide. There is a proximity sensor in the small room to detect the presence of a child. There is also a proximity sensor located midway down the slide. If a child enters the small room, he or she is prompted to "Go down the slide." Once down the slide, a "crowd cheer" sample will sound as an audio reward for going down the slide. If no child enters the small room for 1 minute, the system supervisor unit will read a scene within the scene file telling it to load a new rule, scene and MIDI files. The "Go down the slide" response has a higher priority (100) in the scene file than the "Crowd cheer" response priority (99). This means that if both sensors trigger simultaneously, the "Go down the slide" response will have senior priority and will run first. In the code, E1 refers to the small room sensor, E2 is the slide sensor. "Go down the slide" is S1 and "Crowd cheer" is S2. S3 will load a new set of games by loading a new scene, rule and MIDI file for the small room and slide.

T1*1800S1^0 ;start a one minute timer after the scene 1 runs

T2*90E2^1 ;start a 3 second timer after the slide sensor trips

V1*1E1^1 ;child in the small room sets V1 to one

V2*1T2^0 ;V2 is set when T2 counts to zero (child at bottom of slide)

V1*0S1^1 ;reset variable V1 after "Go down the slide" runs

V2*0S2^0 ;reset variable V2 after "Crowd cheer" runs

S1*1V1=1 ;run scene 1 then V1=1

S2*1V2=1 ;run scene 2 when V2=1

S3*1T1^0 ;load new rule and scene file if 1 minute is up

The above rule file executes similar to that of an infinite "While Loop" once each frame. The following scene file then provides an output response:

| Scene | Description | Priority | Duration | Non-Repeat | Spool | Mix1–Mix8 | MIDI1–MIDI8 |
|---|---|---|---|---|---|---|---|
| S1 | Go down the slide | 100 | 200 | 300 | 0 | 0, 0, 0, 0, 0, 0, 0, 0 | 1, 0, 0, 0, 0, 0, 0, 0 |
| S2 | Crowd cheer | 99 | 800 | 1000 | 300 | 0, 0, 0, 0, 0, 0, 0, 0 | 0, 2, 0, 0, 0, 0, 0, 0 |
| S3 | Game #2 | 999 | 999 | 999 | 999 | | |

The above scene file will obtain information from the MIDI file as to which audio sample will be played. In the scene file, the MIDI1–MIDI8 fields refer to an individual MIDI compatible device. The number in a particular MIDI1–MIDI8 field position is a line number reference to the MIDI file. The MIDI file is the one associated with the scene file and both are retrieved together. For example, in the first line of the scene file the "1" in the first field of the MIDI1–MIDI8 fields is referring to line #1 of the MIDI file. In this example, we are assuming that there are two MIDI devices: Digital audio sampler #1 and Digital audio sampler #2. Sampler #1 is the first MIDI device as indicated by the MIDI1 field. Sampler #2 is the second MIDI device as indicated by the MIDI2 field. Sampler #1 will operate on MIDI channel #8 and Sampler #2 will operate on the MIDI channel #9 in this example. The resulting MIDI file is as follows:

| Line # | Type | Channel | Note | Velocity |
|---|---|---|---|---|
| 1 | ON | 8 | 24 | 64 |
| 2 | ON | 9 | 35 | 64 |

The "Go down the slide" audio response is digitally stored in Sampler #1. Within Sampler #1, this sample is referenced by the "note" 24. The "Crowd cheer" response is digitally stored in Sampler #2. Within Sampler #2, the crowd cheer sample is referenced by the "note" 35. No reference is needed for scene 3, as a completely new rule, scene, and MIDI file will be loaded.

Figure 5:
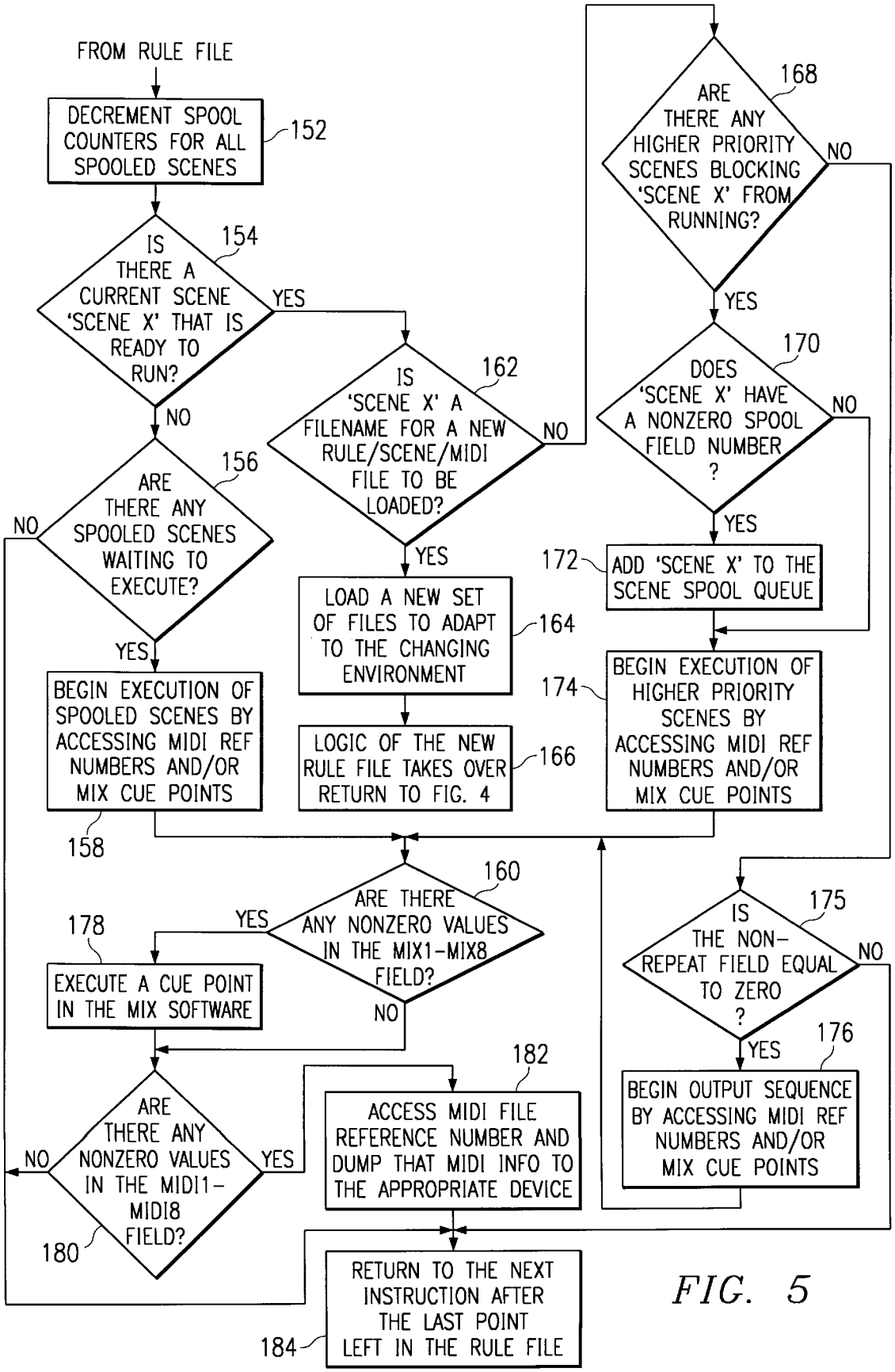
FIG. 5 is a flow chart of an illustrative example of a behavioral based environmental system (BBES) according to one embodiment of the present invention.

The previous illustrative example is shown in FIGS. 4 and 5. FIGS. 4 and 5 are flowcharts illustrating a one embodiment of the present invention in flowchart form. A command is entered at a system keyboard coupled to the system supervisor unit 36. The command is processed by the system supervisor unit 36 after the "enter" key is depressed in step 100. This causes the system supervisor unit 36 to load initial scene, rule and MIDI files in order to begin processing. In this example, the files from the illustrative example described above are loaded. When step 100 is encountered again the system supervisor unit 36 will determine if a new command has been issued based on activation of the "enter" key, otherwise the system supervisor unit 36 will go on to step 102 to test all rules in the rule file that is current. The screen is then updated in step 104. Steps 100, 102 and 104 occur regardless of the contents of the scene file. Next, in step 106 the system supervisor unit 36 looks at the S1 variable to determine if scene 1 has run and been completed. If scene 1 ran the system supervisor unit 36 sets T1 to 1800 frames, or one minute worth of time at 1/30 of a second per frame, in step 108. The system supervisor unit 36 will also reset variable V1 to zero, indicating a false condition, in step 110. After either step 106 or step 110 is completed, the system supervisor unit 36 tests whether T1 had been set, more specifically, whether T1 is not equal to zero in step 112. If T1 was set then it is decremented in step 114. After either step 112 or step 114 is completed, the system supervisor unit 36 examines slide sensor E2 to determine whether it was tripped in step 116. If E2 made a logical zero to one transition the system supervisor unit 36 will interpret this as caused by the presence of a child in step 116. If the sensor was tripped, T2 is set to 90 in step 118. After either step 116 or step 118 is completed, the system supervisor unit 36 examines T2 in step 120 to determine if it was set. If T2 is not equal to zero, it is decremented in step 122.

After either step 120 or step 122 is completed, the system supervisor unit 36 examines small room sensor E1 in step 124 to determine if it was tripped. If E1 made a logical zero to one transition the system supervisor unit 36 will interpret this as caused by the presence of a child in step 124 and set variable V1 to one in step 126. After either step 124 or step 126 is completed, the system supervisor unit 36 examines whether T2 has counted down to zero in step 128. If T2 is equal to zero then variable V2 is set to one, a true state, in step 130. After either step 128 or step 130 is completed, S2 is examined to determine if scene two has completed in step 132. If scene two had been completed, then variable V2 is reset to zero, a false condition, in step 134. After either step 132 or step 134 is completed, variable V1 is tested to determine if it is true, in step 136. If V1 is true, i.e. set to logical one, then the system supervisor unit 36 will attempt to execute scene one in step 138. Step 138 leads to further steps illustrated in FIG. 5, specifically step 152. After either step 136 or the steps of FIG. 5 are executed as indicated in step 138, the system 30 examines variable V2 to determine if it is set to a true value, in step 140. If V2 is true, as represented by a logical one, then the system 30 will attempt to execute scene 1 in step 142. As in step 138, step 140 refers to the steps of FIG. 5, beginning with step 152, described below. After either step 140 or the steps of FIG. 5 are executed as indicated in step 142, the system 30 examines T1 to determine if it has counted down to zero in step 144. If T1 is equal to zero then the system 30 will go to step 152 of FIG. 5 and after following the appropriate steps, load new files as indicated in step 146. If T1 is not equal to zero then the system 30 will reset all event variables to zero in step 148, and execute the scene file logic in step 150 as further described in FIG. 5. After step 150 is completed, the system 30 returns to step 100 and the process begins again.

FIG. 5 illustrates in a flow chart diagram the steps performed by the system supervisor unit 30 after the steps of FIG. 4. For example, after steps 138, 142, 146, or 150 of FIG. 4, the system supervisor unit 30 will decrement spool fields, which act as counters, for all spooled scenes, in step 152. Next, the system 30 will determine if there is a current scene to be run in step 154, as indicated by the rule file. If there are no scenes ready to run then the system 30 determines if there are any spooled scenes waiting to run in step 156. If there are no spooled scenes waiting to execute then the system 30 returns to the next instruction after the last point left in the rule file in step 184. However, if there are spooled screens waiting to execute then the system 30 will begin execution of spooled scenes by accessing the appropriate Mix or MIDI devices in step 158. After step 158 is completed the system will continue with step 160 as further described below. Returning to step 154, if there is a current scene that is ready to run then the system 30 determines whether that scene has a filename in the description field of the scene file that indicates new files are to be loaded in step 162. If new files are to be loaded, this occurs in step 164 and the system 30 returns to the steps in FIG. 4 with the logic of the new rule file controlling system 30 operation.

However, if in step 162 new files are not to be loaded then the system 30 tests whether there are any higher priority scenes blocking the current scene "scene x" from running in step 168. If there are, the system 30 further tests in step 170 whether "scene x" has a nonzero spool field number. If the spool field number is nonzero, then "scene x" is added to the scene spool queue in step 172. However, if the spool field number is zero, then the system 30 will begin execution of the highest priority scene by accessing the appropriate Mix and MIDI devices in step 174, then continuing to step 160 as described below. Step 174 is also executed after step 172 is completed as well.

If at step 168 there were no higher priority scenes blocking "scene x" (the current scene) then the system 30 will determine if the value of the non-repeat field is equal to zero in step 175. If the non-repeat field is not equal to zero then the system jumps to step 184 and returns to the next instruction after the last point left in the rule file, as depicted in FIG. 4. However, if the non-repeat field is equal to zero, the system 30 will begin execution of the current scene by accessing the appropriate Mix and MIDI devices in step 176, as described below.

After steps 158, 174 and 176 are completed, the system 30 determines whether there are any nonzero values in the Mix1–Mix8 fields in step 160. If there are nonzero values then a cue point instruction is sent to the appropriate mix device so that the associated effect can be initiated in step 178. After either step 160 or step 178 is completed, the system 30 determines whether there are any nonzero values in the MIDI1–MIDI8 fields, in step 180. If there are nonzero values in the MIDI fields then the appropriate MIDI device is referenced by the number in the corresponding MIDI field in step 182. After either step 180 or step 182 has completed, the system executes step 184 to return to the next instruction after the last point left in the rule file in FIG. 4.

Returning to FIG. 3, in an alternative embodiment of the present invention the system supervisor unit 36 is connected through a bidirectional line 200 to a bidirectional modem 202. The bidirectional modem 202 is further connected through another bidirectional line 204 to a public telephone line 206. The bidirectional modem 202 is adapted to transmitting information between the system supervisor unit 36 and the public telephone line 206. Transmitting information between the system supervisor unit 36 and the public telephone line 206 enables useful interaction with a remote system (not shown). The remote system can be any type of system capable of telephone communication including a remote computer terminal or another interactive playground. Via the telephone connection described, scene, rule and MIDI files, as well as variables, are transferred back and forth between the system supervisor unit 36 and the remote system. Diagnostic routines are also downloaded from, and initiated by, the remote system. Results from the diagnostic routine are read by the remote system over the public telephone line 206 after completion of the diagnostic routine. Diagnostic routine results can tell a person utilizing the remote system of problems with the interactive playground. Diagnostics also indicate the number of sensor trips (sensor triggerings) during a particular period of time, thus indicating playground usage. Note that other telephone lines, such as dedicated private telephone lines, can be substituted for the public telephone line 206 employed here. As mentioned above, the remote system can take the form of another interactive playground. The other interactive playground will share some rule, scene and MIDI files with the system supervisor unit 36. Therefore, network gaming, i.e. generally the sharing of files between different systems to control interactive environments, is enabled through the above described connections over the public telephone line 206.

Thus, there has been described herein a behavioral based environmental system and method for implementing an interactive playground.

The program listing in the microfiche appendix is a present preferred listing for the behavioral based environmental system and method for an interactive playground described above:

What is claimed is:

1. A behaviorally based environment system for controlling an interactive playground, comprising:

a plurality of sensors for sensing changes in such playground and producing a plurality of corresponding sensor outputs;

a system supervisor unit running system supervisor software and adapted to receive and utilize said plurality of sensor outputs to select a current scene file, a rule file, and an audio file to produce an output signal, said system supervisor unit using the rule file to select a scene from the scene file responsive to said plurality of sensor outputs and further being capable of selecting next rule file in response to a plurality of sensor outputs calling for it to do so;

a music computer adapted to receive, and be directed by said system supervisor unit output signal to retrieve, a stored music file containing audio instructions from a memory storage device, said music computer transmitting at least one audio output signal in accordance with said retrieved music file;

a digital audio sampler, responsive to said music computer audio output signal for accessing at least one set of sound representations and selecting one of said sound representations in order to generate a sound sequence; and a speaker system for converting said sound sequence into sound.

2. The behaviorally based environment system of claim 1, further comprising:

an effects computer adapted to receive and be directed by said system supervisor unit output signal to access a memory storage device to retrieve a scene file containing at least one scene, said effects computer adapted to receive and be directed by said system supervisor unit output signal to retrieve a stored effects file containing control instructions from a memory storage device, said effects computer controlling at least one signal in accordance with said retrieved effects files; and a mixing fader unit adapted to receive said effects computer output signal and controlling at least one light as directed by said effects computer output signal.

3. The behaviorally based environment system of claim 2, wherein said system supervisor unit uses said scene file to select said next rule file.

4. The behaviorally based environment system of claim 2, wherein said rule file causes said system supervisor software to replace said scene file by reading another scene file.

5. The behaviorally based environment system of claim 2, further comprising a modem coupled to said means for applying rules, said modem adapted for communicating over a telephone line.

6. The behaviorally based environment system of claim 1, wherein said system supervisor unit uses said scene file to select said next rule file.

7. The behaviorally based environment system of claim 1, wherein said rule file causes said system supervisor software to replace said scene file by reading another scene file.

8. A behaviorally based environment system for controlling an interactive playground, comprising:

a plurality of sensors for sensing changes in such playground and producing a plurality of corresponding sensor outputs;

a system supervisor unit running system supervisor software and adapted to receive and utilize said plurality of sensor output to select a current scene file, a rule file, and an audio file to produce an output signal, said system supervisor unit using the rule file to select a scene from the scene file responsive to said plurality of sensor outputs and further being capable of selecting a next rule file in response to a plurality of sensor outputs calling for it to do so; and an output device, coupled to said system supervisor unit, for transmitting said output signal to such interactive playground.

9. The behaviorally based environment system of claim 8, wherein said system supervisor unit uses said scene file to select said next rule file.

10. The behaviorally based environment system of claim 8, wherein said rule file causes said system supervisor software to replace said scene file by reading another scene file.

* * * * *